United States Patent [19]

Künnecke

[11] Patent Number: 4,543,893

[45] Date of Patent: Oct. 1, 1985

[54] LINING BRICK

[75] Inventor: Manfred Künnecke, Taunusstein, Fed. Rep. of Germany

[73] Assignee: Didier-Werke AG, Wiesbaden, Fed. Rep. of Germany

[21] Appl. No.: 604,364

[22] Filed: Apr. 26, 1984

[30] Foreign Application Priority Data

May 5, 1983 [DE] Fed. Rep. of Germany ..... 3316372

[51] Int. Cl.[4] ..... F23M 5/02

[52] U.S. Cl. ..... 110/338; 52/605; 432/119

[58] Field of Search ..... 110/338, 339, 340; 432/119; 52/605

[56] References Cited

U.S. PATENT DOCUMENTS 2,230,142 1/1941 Longacre .
4,340,360 7/1982 Hoedl et al. ..... 432/119

FOREIGN PATENT DOCUMENTS 7611927 4/1976 Fed. Rep. of Germany .
2534973 2/1977 Fed. Rep. of Germany .
2902906 1/1979 Fed. Rep. of Germany ..... 110/338

*Primary Examiner*—Edward G. Favors
*Attorney, Agent, or Firm*—Wenderoth, Lind & Ponack

[57] ABSTRACT

A lining brick for forming a refractory lining includes a hot side surface, a shell side surface opposite the hot side surface, a pair of spaced opposite hearing surfaces, a pair of spaced opposite butt surfaces, and recesses opening onto the shell side surface. The recesses are formed only in the spaced opposite bearing surfaces or in the spaced opposite butt surfaces. Each recess has a first side opening onto the shell side surface and a second side opening onto the respective butt or bearing surface. Each recess is defined by a surface portion having a first end terminating at the shell side surface and a second end terminating at the respective butt or bearing surface. The total area of the first ends of all of the recesses that lie in the plane of the shell side surface is less than the area of the shell side surface.

10 Claims, 5 Drawing Figures

LINING BRICK

BACKGROUND OF THE INVENTION

The present invention relates to a lining brick for use in forming refractory linings for receptacles such as furnaces, and particularly for rotary kilns. More specifically, the present invention relates to such a lining brick of the type having a hot side surface adapted to be directed toward the interior of the furnace, a planar shell side surface opposite the hot side surface and adapted to contact the shell of the furnace, first and second pairs of spaced opposite lateral side surfaces extending between the hot side and shell side surfaces, and recesses opening onto the shell side surface.

A lining brick of this general type is disclosed in U.S. Pat. No. 2,230,142. Insulating material is placed in the recesses of these bricks for the purpose of reducing the heat transferred from the interior of the furnace to the furnace shell. To obtain a maximum insulating effect, the recesses on the shell side surface include a center recess between two lateral recesses. Thus, the brick abuts the shell at two narrow webs only. However, it has been determined that during operation of a furnace lined with this type of bricks, due to the relative movement between the lining and the shell, the ceramic brick material of the narrow webs of the bricks crumbles away, thus abrading the brick material. This considerably weakens the strength of the lining. This damage is very serious in a rotary kiln lining, wherein the bricks are subjected to stresses caused by changing loads.

West German DE-OS No. 25 34 973 discloses a lining brick having on the shell side surface one or more recesses that are filled with insulating material. The webs remaining in the vicinity of the insulating material are narrow compared to the size of the recess. Thus, in the area of the webs the brick is weakened considerably so that damage to the bricks occurs during operation.

West German DE-GM No. 76 11 927 discloses a lining brick having holes. The shell side surface of the brick has no openings or recesses and abuts the furnace shell over the entire surface. The total volume of the holes is to be 10 to 30% of the volume of the brick formed without openings. Thus, compared to a full brick without openings, the weight is reduced. This weight reduction has a favorable effect on the cost of the brick. However, it is difficult to form the openings, and it is unlikely that the price of this brick can be lowered to an extent to be commercially feasible. Furthermore, this brick has thin wall sections between adjacent openings, and although these thin wall sections are less apt to be damaged during operation than the webs of the other above discussed prior art arrangements, breakage of such thin wall sections during operation cannot be totally avoided.

SUMMARY OF THE INVENTION

With the above discussion in mind, it is the object of the present invention to provide an improved lining brick of the general type described above, but whereby it is possible to overcome the above and other prior art disadvantages.

It is a further object of the present invention to provide such a lining brick having a construction such that it is not easily damaged during operation.

It is a yet further object of the present invention to provide such a lining brick whereby the cost of the material of the brick is reduced without increasing the cost of formation of the brick.

These objects are achieved in accordance with the present invention by the provision of a lining brick wherein the recesses are formed only in one of the pairs of spaced opposite lateral sides of the brick, i.e. the recesses are formed either in the butt surfaces of the brick only or in the bearing surfaces of the brick only. Each recess has a first side opening onto the shell side surface and a second side opening onto the respective lateral side, and each recess is defined by a surface portion having a first end terminating at the shell side surface and a second end terminating at the respective lateral side. The total area of the first ends of all of the recesses that lie in the plane of the shell side surface is less than the area of the shell side surface of the brick. The shell side surface otherwise is unbroken.

Since the shell side surface is larger than the sides of the recesses lying in the plane of the shell side surface, the brick portion remaining between the recesses is large and thus can withstand relatively high mechanical stresses.

The recesses easily can be provided during the normal molding or production of the bricks, and it is not necessary to provide special operations for forming the recesses. Therefore, the savings in brick material is not offset by increased operating costs. The recesses form insulation chambers such that it is possible to reduce the amount of the heat transmitted from the furnace or hot side surface to the shell side surface.

In accordance with a preferred arrangement of the present invention, the total area of the ends of all of the recesses that lie in the plane of the shell side surface is approximately 30 to 40% of the area of the shell side surface.

In accordance with a further feature of the present invention, preferably the dimensions of the recesses in a linear direction between the respective pair of lateral sides, measured at the plane of the shell side surface, is approximately 30 to 40% of the distance between such pair of lateral sides measured at such plane.

In accordance with a further preferred feature of the present invention, the total volume of all of the recesses is approximately 10 to 15% of the total volume the brick would have if formed without the recesses, i.e. of the sum of the volume of the actual brick plus the total volume of the recesses.

In accordance with one embodiment of the present invention, the recesses are formed in the opposite bearing surfaces of the brick and are laterally spaced from each other and from the butt surfaces of the brick. By this arrangement, the corner areas and the areas between the recesses at the shell side surface of the brick are not reduced by the dimensions of the recesses. This has a particularly favorable effect on the strength of the brick.

In accordance with another embodiment of the present invention, the recesses are formed in the opposite butt surfaces, and each recess is continuous between the laterally spaced bearing surfaces. In this embodiment of the present invention, the surface portion defining each recess may be in the form of a curved concave surface or an oblique surface extending between the shell side surface and the respective butt surface. This embodiment of the present invention has the advantage that a continuous strip of insulating material can be inserted in the continuous recess formed by adjacent recesses of abutting bricks.

BRIEF DESCRIPTION OF THE DRAWINGS

Other objects, features and advantages will be apparent from the following detailed description of preferred embodiments, with reference to the accompanying drawings, wherein.

DETAILED DESCRIPTION OF THE INVENTION

Figure 1:
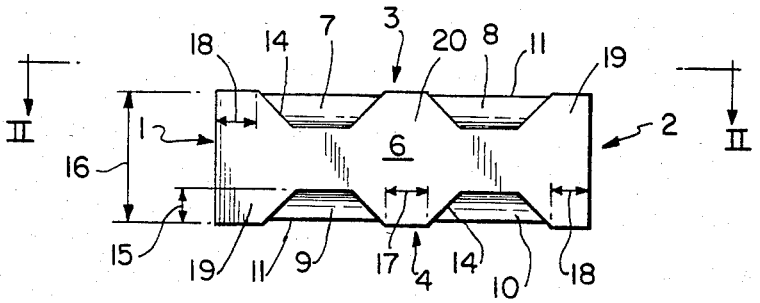
FIG. 1 is an elevation view of a first embodiment of a brick according to the present invention, as viewed from the shell side and along the line I—I of FIG. 2.
Figure 2:
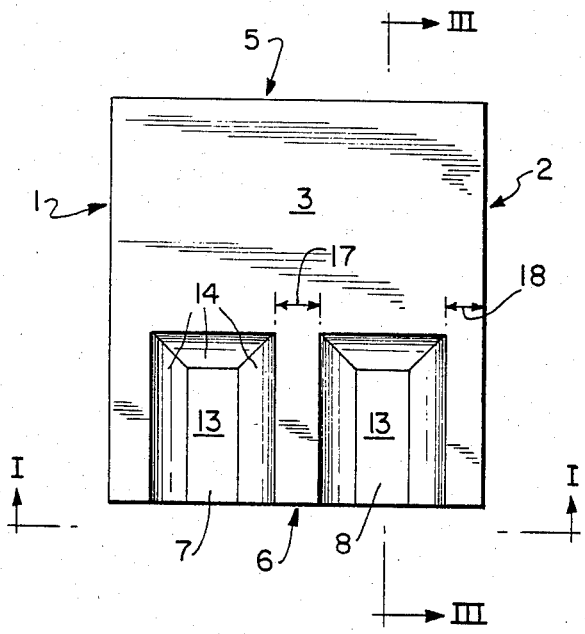
FIG. 2 is a side view of the brick taken along the line II—II of FIG. 1.
Figure 3:
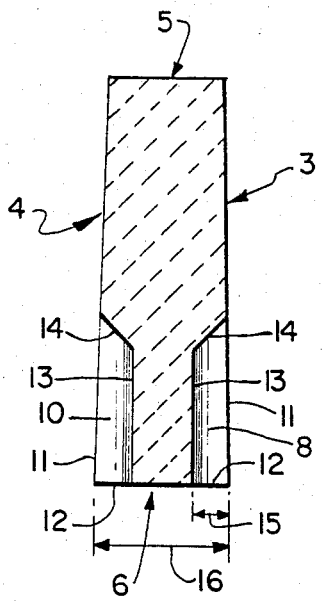
FIG. 3 is a cross-sectional view taken along the line III—III of FIG. 2.

With reference to FIGS. 1–3, a first embodiment of the present invention now will be described. The lining brick of this embodiment has a furnace or hot side surface 5 adapted to be directed toward the interior of a furnace and a planar shell side surface 6 opposite the hot side surface 5 and adapted to contact the shell of a furnace. A first pair of spaced opposite lateral sides are defined by opposite butt surfaces 1 and 2, and a second pair of spaced opposite lateral sides are defined by a pair of spaced lateral bearing surfaces 3 and 4. Butt surfaces 1 and 2 generally are parallel, and bearing surfaces 3 and 4 generally converge in the manner of a wedge from the shell side surface 6 to the hot side surface 5, as shown in FIG. 3. In other words, the dimension of the brick between surfaces 3 and 4 is greater at surface 6 than at surface 5. When this brick is provided in the lining of a rotary kiln, a plurality of the bricks abut at bearing surfaces 3 and 4 to form a ring. Bricks of adjacent rings abut at butt surfaces 1 and 2. The shell side surfaces 6 of all of the bricks abut the shell of the rotary kiln.

In accordance with the present invention, in the embodiment of the lining brick shown in FIGS. 1–3, each bearing surface 3 and 4 is provided with two identically shaped recesses 7 and 8, 9 and 10. Each recess 7–10 has a first side 12 opening onto the shell side surface 6 and a second side 11 opening onto the respective bearing surface 3 or 4. Each recess is defined by a surface portion 13, 14 having a first end terminating at the shell side surface 6 and a second end terminating at the respective bearing surface 3 or 4. This relationship particularly is apparent in FIG. 3. In the particular arrangement shown in FIGS. 1–3, the surface portion defining the recess includes a bottom or base surface 13 terminating at surface 6 and three chamfer or bevel surfaces 14 terminating at the respective bearing surface 3 or 4. It should be understood however that each recess could be defined by a single smooth surface.

The total area of the first ends 12 of all of the recesses 7–10 that lie in the plane of the shell side surface 6 is less than the area of the actual or remaining shell side surface 6 of the brick in such plane. The total area of the first ends 12 of all of the recesses preferably is approximately 30 to 40% of the area of the shell side surface 6. In the arrangement illustrated in FIGS. 1–3, such total area is approximately 36% of the area of surface 6.

In accordance with the present invention, the sum of the dimensions of recesses 7–10 in a linear direction between the bearing surfaces 3 and 4, measured at the plane of shell side surface 6, is approximately 30 to 40% of the distance between bearing surfaces 3 and 4 measured in such plane. In other words, the recesses in the opposite bearing surfaces are aligned as shown in FIG. 1, and the total dimension 15 of the pairs of facing recesses is approximately 30 to 40% of the dimension 16 between surfaces 3 and 4. Dimensions 15 and 16 are measured in the plane of surface 6. Similarly, the sum of the dimensions 15 of opposed recesses 8, 10 is approximately 30 to 40% of the dimension 16.

In accordance with a further feature of the present invention, the total volume of all of recesses 7–10 is approximately 10 to 15% of the sum of the volume of the brick formed with identical dimensions but without recesses. In other words, the total volume of all of the recesses is approximately 10 to 15% of the sum of the volume of the actual brick plus the total volume of the recesses.

Each pair of recesses 7 and 8 or 9 and 10 are spaced from each other by a distance 17, and each recess is spaced by a distance 18 from an adjacent butt surface 1 or 2. Thus, the four corner areas 19 of shell side surface 6 and the center area 20 of the shell side surface are not unduly narrowed by the recesses 7–10. In other words, the dimensions of all brick portions at the surface 6 are sufficient to prevent damage due to stress during operation. In an actual arrangement, distances 17, 18 would be approximately from 1 to 3 cm, depending upon the size of the particular brick. It will be apparent that in accordance with this embodiment of the present invention, the strength of the brick is substantial, since none of the recesses penetrates entirely between opposed bearing surfaces 3 and 4 or entirely between opposed butt surfaces 1 and 2. Therefore, the surface 6 in contact with the shell of the furnace is of substantial size and strength compared with prior art bricks.

Figure 4:
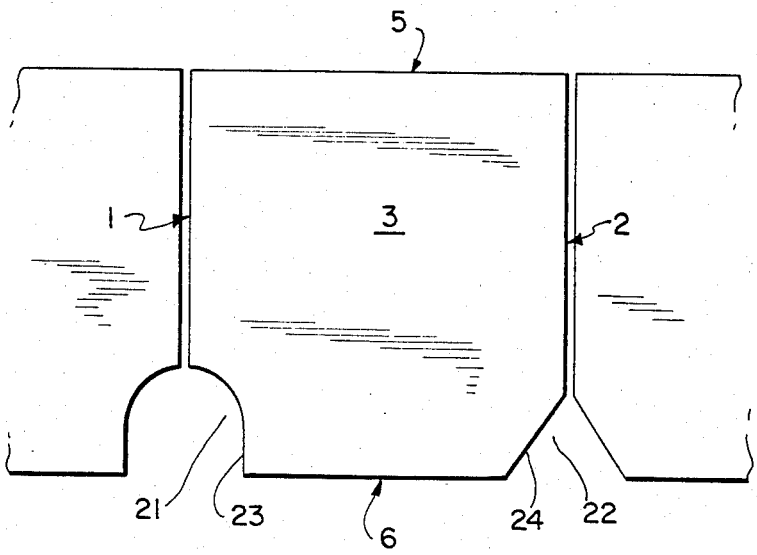
FIG. 4 is a view similar to FIG. 2 but of another embodiment of the present invention, and also illustrating the relationship thereof to adjacent bricks.
Figure 5:
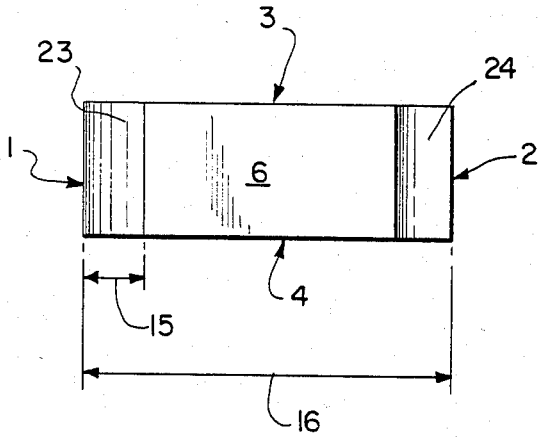
FIG. 5 is a view similar to FIG. 1, but of the embodiment of FIG. 4.

In the embodiment of FIGS. 4 and 5, recesses 21 and 22 are formed in the butt surfaces 1 and 2 and are continuous between the spaced, opposed bearing surfaces 3 and 4. Each recess has a first side opening onto surface 6 and a second side opening onto the respective butt surface 1 or 2. Each recess is defined by a surface portion 23, 24 having a first end terminating at surface 6 and a second end terminating at the respective butt surface 1 or 2. The total area of the first ends of all of recesses 21 and 22 that lie in the plane of shell side surface 6 is less than the area of shell side surface 6, and preferably approximately 30 to 40% thereof.

Also, in this embodiment, the sum of the dimensions 15 of recesses 21, 22 in a linear direction between butt surfaces 1 and 2, measured at the plane of shell side surface 6, is approximately 30 to 40% of the distance 16 between butt surfaces 1 and 2, measured in the plane of surface 6. Furthermore, in this embodiment, the total volume of all of recesses 21, 22 is approximately 10 to 15% of the sum of the volume of the brick if formed without the recesses, i.e. of the sum of the volume of the brick plus the total volume of the recesses.

FIG. 4 shows the recesses 21 and 22 with different profiles. Thus, recess 21 is defined by a surface portion in the form of a curved concave surface 23 having a first end terminating at surface 6 and a second end terminating at surface 1. Recess 22 is shown as being formed by a surface portion in the form of an oblique surface 24 having a first end terminating at surface 6 and a second end terminating at surface 2. In actual practice however, as will be apparent to those skilled in the art, a particular brick will have identically shaped recesses formed in both surfaces 1 and 2.

A particular advantage of the lining brick shown in the embodiment of FIGS. 4 and 5 is that when a plurality of bricks are abutted at surfaces 3 and 4, the recesses 21, 22 will align to form a continuous recess, for example an annular recess. The recesses of adjacent rings in a rotary kiln will be contiguous as shown in FIG. 4, and continuous strips of insulating or sealing material may be filled into such recesses.

In accordance with the present invention, there is provided a lining brick having recesses to form insulation chambers, but wherein the brick surface to contact a furnace shell is of sufficient size and dimensions to avoid damage such as crumbling or abrasion due to mechanical stresses. Furthermore, the brick of the present invention provides a significant savings in material without requiring special production methods increasing production costs. The shell contacting surface 6 is not completely broken at any position, and thus there is no predisposition toward excessive wear, even when the brick is subjected to high mechanical stresses. Compared to a full brick without recesses, the recesses of the brick of the present invention increase very little the brick surface that is subjected to strain producing loads, although such recesses result in a considerable saving of brick material and provide heat insulation chambers. The recesses easily can be formed during normal production of the brick, and without special processing operations, since the recesses are relatively shallow.

Although the present invention has been described and illustrated with respect to preferred embodiments thereof, it is to be understood that various modifications and changes may be made to the specifically described and illustrated features without departing from the scope of the present invention.

I claim:

1. In a lining brick for use in forming refractory linings for receptacles such as furnaces, particularly rotary kilns, said brick being of the type comprising a hot side surface adapted to be directed toward the interior of a furnace, a planar shell side surface opposite said hot side surface and adapted to contact the shell of the furnace, a first pair of spaced opposite lateral sides extending between said hot side and shell side surfaces, a second pair of spaced opposite lateral sides extending between sid hot side and shell side surfaces and converging between said shell side and hot side surfaces, and recesses opening onto said shell side surface, the improvement wherein:

said recesses are formed in spaced opposite lateral sides of one of said pairs only;

each said recess has a first side opening onto said shell side surface and a second side opening onto the respective lateral side of said one pair of spaced opposite lateral sides;

each said recess is defined by a surface portion having a first end terminating at said shell side surface and a second end terminating at said respective lateral side; and the total area of said first ends of all of said recesses that lie in the plane of said shell side surface is less than the area of said shell side surface.

2. The improvement claimed in claim 1, wherein said total area is approximately 30–40% of said area of said shell side surface.

3. The improvement claimed in claim 1, wherein the sum of the dimensions of said recesses in a linear direction between said one pair of lateral sides, measured at said plane of said shell side surface, is approximately 30–40% of the distance between said one pair of lateral sides, measured at said plane.

4. The improvement claimed in claim 1, wherein the total volume of all of said recesses is approximately 10–15% of the sum of the volume of said brick plus said total volume of said recesses.

5. The improvement claimed in claim 1, wherein said first pair of sides are defined by spaced butt surfaces, and said second pair of sides are defined by spaced bearing surfaces.

6. The improvement claimed in claim 5, wherein said recesses are formed in said bearing surfaces and are laterally spaced from said butt surfaces.

7. The improvement claimed in claim 6, wherein plural, laterally spaced said recesses are formed in each said bearing surface.

8. The improvement claimed in claim 5, wherein said recesses are formed in said butt surfaces, each said recess being continuous between said bearing surfaces.

9. The improvement claimed in claim 8, wherein said surface portion defining each said recess comprises a curved concave surface extending between said shell side surface and the respective said butt surface.

10. The improvement claimed in claim 8, wherein said surface portion defining each said recess comprises an oblique surface extending between said shell side surface and the respective said butt surface.

* * * * *